US006159057A

United States Patent [19]

Bernardini

[11] Patent Number: 6,159,057

[45] Date of Patent: Dec. 12, 2000

[54] HIGH CURRENT CONNECTOR USING TUNING FORK CONTACTS

[75] Inventor: Allen J. Bernardini, Southbury, Conn.

[73] Assignee: Litton Systems, Inc., Woodland Hills, Calif.

[21] Appl. No.: 09/184,347

[22] Filed: Nov. 2, 1998

[51] Int. Cl.[7] ..... H01R 13/15; H01R 4/48

[52] U.S. Cl. ..... 439/801; 439/259; 439/833; 439/265

[58] Field of Search ..... 439/801, 259, 439/263, 806, 815, 630, 832, 833, 262, 593, 265, 927

[56] References Cited

U.S. PATENT DOCUMENTS

| | | | |
|---|---|---|---|
| 3,082,399 | 3/1963 | Brandhorst . | |
| 5,454,727 | 10/1995 | Hsu | 439/263 |
| 6,004,141 | 12/1999 | Abe et al. | 439/73 |

*Primary Examiner*—Paula Bradley
*Assistant Examiner*—Edwin A. León
*Attorney, Agent, or Firm*—Lowe Hauptman Gopstein Gilman & Berner, LLP

[57] ABSTRACT

Disclosed is an electrical connector of the blade and contact type in which the contact has a tuning fork shape. The tuning fork includes a first tine and a second tine which are spaced apart and are initially parallel to each other. The first and second tines form an elongated slot therebetween. An adjustable tensioner includes an elastic member mounted exterially of one of the tines and a set screw which extends through the elastic member and one of the tines and is engaged with the other of the tines. By adjusting the set screw, the second of the tines is biased in a direction towards the first of the tines and the spacing between the first and second tines is reduced. In this manner, the contact pressure and spacing can be adjusted so that when the blade is inserted into the slot formed by the tines, the frictional resistance can be adjusted. The blade can either be vertically or longitudinally inserted into the slot.

20 Claims, 3 Drawing Sheets

HIGH CURRENT CONNECTOR USING TUNING FORK CONTACTS

FIELD OF THE INVENTION

The present invention relates generally to electrical connectors, and more particularly, to connectors having blade type contacts.

BACKGROUND OF THE INVENTION

High electrical current connectors frequently use blade type contacts. Blade type connectors include a blade that frictionally fits into a contact having an elongated slot. The disadvantage of such connectors is that over time the frictional fit between the blade and the contact becomes worn. Another disadvantage is initially the frictional fit between blade and contact may be either too tight or too loose resulting in variations in insertion force. If the frictional fit is too tight, the blade may be difficult to insert and difficult to remove from the contact. If the frictional fit is too loose, then there may not be good electrical contact between the blade and the contact. Accordingly, a need exists in the art for a blade and contact type connector in which the frictional resistance between the blade and contact can be adjusted.

SUMMARY OF THE INVENTION

It is, therefore, an object of the present invention to provide an electrical connector of the blade and contact type in which the frictional resistance between the blade and the contact is adjustable.

It is another object of the present invention to provide a blade and contact type connector in which a series of contacts are arranged in which the frictional resistance for each contact is adjustable.

It is another object of the present invention to provide an electrical connector which is easy to manufacture, reliable in operation and cost effective to produce.

These and other objects are achieved by an electrical connector of the blade and contact type in which the contact has a tuning fork shape. The tuning fork includes a first tine and a second tine which are spaced apart and are initially parallel to each other. The first and second tines form an elongated slot therebetween. An adjustable tensioner includes an elastic member mounted exterially of one of the tines and a set screw which extends through the elastic member and one of the tines and is engaged with the other of the tines. By adjusting the set screw, the second of the tines is biased in a direction towards the first of the tines and the spacing between the first and second tines is reduced. In this manner, the contact pressure and spacing can be adjusted so that when the blade is inserted into the slot formed by the tines, the frictional resistance can be adjusted. The blade can either be vertically or longitudinally inserted into the slot.

The foregoing objects are also achieved by an electrical connector including at least two parallel blades mounted in a shroud. At least two contacts are mounted in a body with each contact having two parallel tines defining a slot. An adjustable tensioner is mounted to each of said contacts and had an adjustment member and an elastic member. Each of the blades is receivable in a corresponding slot. The adjustable tensioner is for adjusting contact pressure with the blades and spacing between the tines.

The foregoing and other objects are also achieved by an electrical connector including at least two blades mounted in a shroud, said adjustable tensioner for adjusting contact pressure with the blades and spacing between the tines. At least two contacts are mounted in a body with each contact having two tines defining a slot. An adjustable tensioner is mounted to each of the contacts and has an adjustment member and an elastic member. The elastic member is located at a distal end of one of the tines and the adjustment member is mounted at the distal end of the tine. The adjustment member extends through the elastic member. The adjustment member is a set screw and the elastic member is located on the exterior of the tine.

Still other objects and advantages of the present invention will become readily apparent to those skilled in the art from the following detailed description, wherein the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawings and description thereof are to be regarded as illustrative in nature, and not as restrictive.

BRIEF DESCRIPTION OF THE DRAWINGS

The present invention is illustrated by way of example, and not by limitation, in the figures of the accompanying drawings, wherein elements having the same reference numeral designations represent like elements throughout and wherein.

BEST MODE FOR CARRYING OUT THE INVENTION

Figure 1:
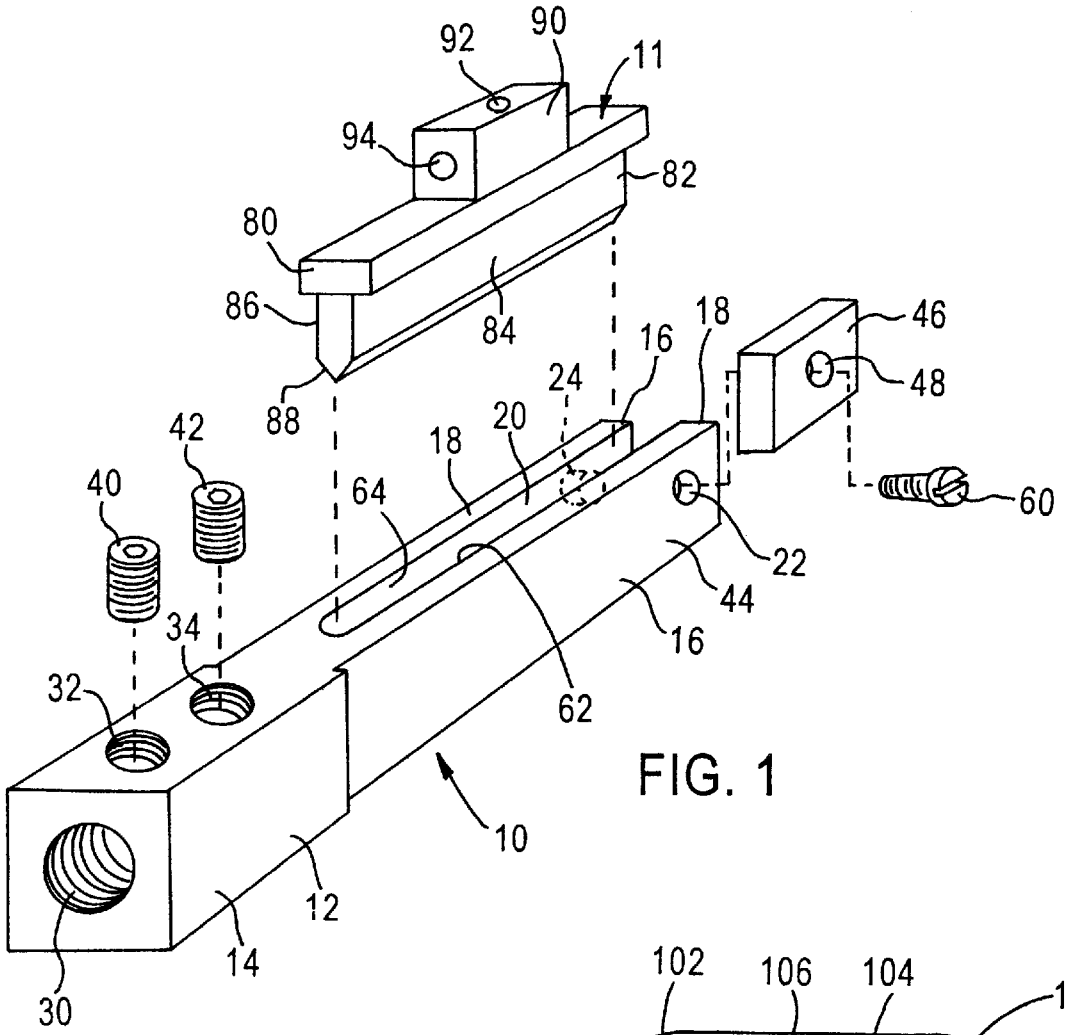
FIG. 1 is an exploded perspective view of the blade and contact connector according to the present invention.

Refer now to FIG. 1 where an electrical connector constructed in accordance with the principles of the present invention is illustrated. For convenience, terms such as "left", "right", "above", and "below" as used herein are to be construed in the relative sense. Although depicted in one orientation, it should be understood that the present invention is usable in any orientation.

As depicted in FIG. 1, the electrical connector includes a tuning fork contact assembly 10 and a blade 11. The tuning fork contact assembly 10 can receive the blade 11 as illustrated in the exploded view. The contact assembly 10 includes a body 12 which has a body portion 14, including a first longitudinally extending first tine 16 and a second longitudinally extending second tine 18. The first tine 16 initially extends substantially parallel to the second tine 18. The first tine 16 and the second tine 18 form a longitudinally elongated slot 20 for receiving the blade 11. An unthreaded through bore 22 is located at a distal end 26 of the first tine 16 and a threaded hole 24 is located at a distal end of the second tine 18. The through bore 22 is aligned with the threaded hole 24. The body portion 14 includes at an end opposite the tines 16, 18 a hole 30 for receiving an electrical wire. A pair of transversely extending threaded holes 32, 34, respectively, intersect with the hole 30. A pair of set screws 40, 42 can be threadedly engaged with holes 32, 34, respectively for holding an end of the electrical wire. It should be understood that other methods of electrically connecting an electrical wire, such a soldering, crimping and the like, can alternatively be used with the present invention.

The first tine 16 has an exterior surface 44. An elastic member 46 has a rectangular shape with a through hole 48 positioned adjacent to the exterior surface 44 and is aligned with the through bore 22. A set screw 60 extends through the hole 48 into the through bore 22 and is threadedly engaged with the threaded hole 24. The amount of threaded engagement of the set screw 60 in the threaded hole 24 determines the amount of bias which the elastic member 46 places on the exterior surface 44 of first tine 16. The first tine 16 can be biased out of a substantially parallel position to reduce the distance between the first tine 16 and the second tine 18. The first tine 16 has an inner surface 62 and a second tine 18 has an inner surface 64. The inner surfaces 62, 64 are spaced apart a distance such that the blade 11 is brought into frictional engagement with the inner surfaces 62, 64. The initial distance that inner surfaces 62, 64 are spaced apart can be varied depending on the amount of compression set screw 60 exerts on the elastic member 46. The elastic member 46 and the set screw 60 are usable as an adjustable tensioner although other arrangements are possible.

The blade 11 includes a non-metallic shoulder portion 80. The blade 11 also includes a metallic blade portion 82 which is co-extensive with shoulder portion 80. The blade portion 82 includes a first external surface 84 and an opposed second external surface 86. At a distal end of the surfaces 84, 86 is a depicted V-shaped distal end of blade portion 82. Alternatively, the distal end 88 can have a rounded shape or any other shape which would facilitate entry of the blade portion 82 into the slot 20 of the tuning fork contact assembly 10. Opposite blade portion 82 is a wire receiving portion 90 which is adjacent to shoulder portion 80. Preferably wire receiving portion 90 is centrally located on the shoulder portion 80. The wire receiving portion 90 includes a wire receiving hole 92 which extends in a transverse direction as depicted in FIG. 1. A longitudinally extending hole 94 for receiving a set screw (not shown) intersects the wire receiving hole 92 for holding an electrical wire.

Figure 2:
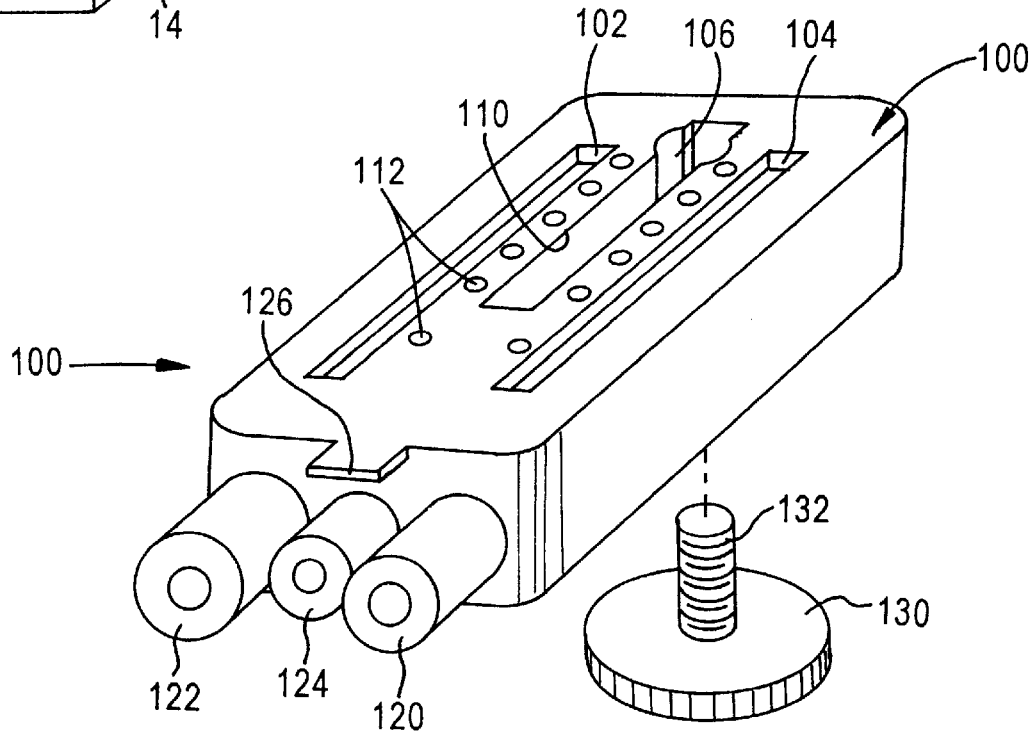
FIG. 2 is a perspective view of a housing for the tuning fork contacts.

As depicted in FIG. 1, the tuning fork contact assemblies are mounted within a hollow non-metallic housing 100. The housing 100 includes first elongated aperture 102 and a second elongated aperture 104. The apertures 102, 104 are for receiving a plurality of spaced blades 11, as discussed in detail below. The housing 100 is hollow and forms a box for protecting the tuning fork contact assemblies 10. As depicted in FIG. 2, the housing 100 would include two tuning fork contact assemblies, although it is to be understood that any number of contact assemblies could be used with the present invention.

The housing assembly 100 can be fabricated in any known manner. It is preferable that the housing 100 can be disassembled so that the contact pressure and spacing for tuning fork contact assemblies 10 can be periodically adjusted as needed. The housing 100 includes a through hole 106 which extends from an upper surface of the housing 100 to a lower surface thereof. A longitudinal slot 110 is located between apertures 102, 104 and can intersect with the hole 106 as depicted. Optionally, a plurality of signal contact holes 112 are located adjacent apertures 102, 104.

A first strain relief 120 is mounted on an exterior surface of the housing 100 and extends in a longitudinal direction for receiving a wire (not shown) to be received in a hole 30 of one of the tuning fork contact assemblies 10. Similarly, a second strain relief 122 is mounted on this same exterior surface of the housing 100 for receiving a different electrical wire for receipt in hole 30 of a second tuning fork contact assembly. A central signal strain relief 124 is mounted between first strain relief 120 and second strain relief 122 through which signal wires can be extended. A tab 126 extends from an upper surface of the housing 100 for mating with a corresponding slot 144 on a shroud assembly described below. A thumb wheel 130 has a threaded portion which extends through hole 106.

Figure 3:
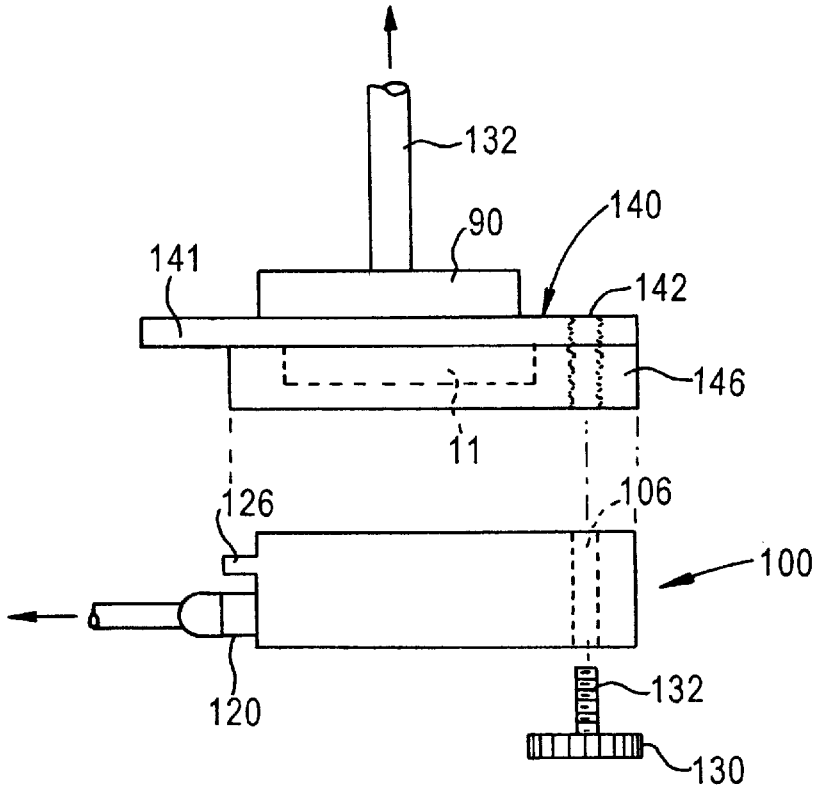
FIG. 3 is an exploded side elevational view of a shroud for the blade connectors and a housing for the contacts.
Figure 4:
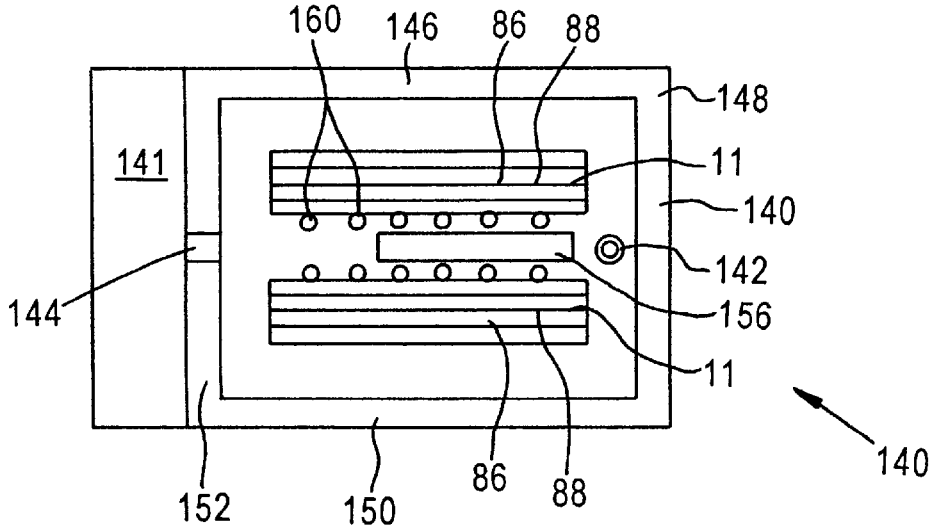
FIG. 4 is a bottom plan view of the shroud for the blade connectors.
Figure 6:
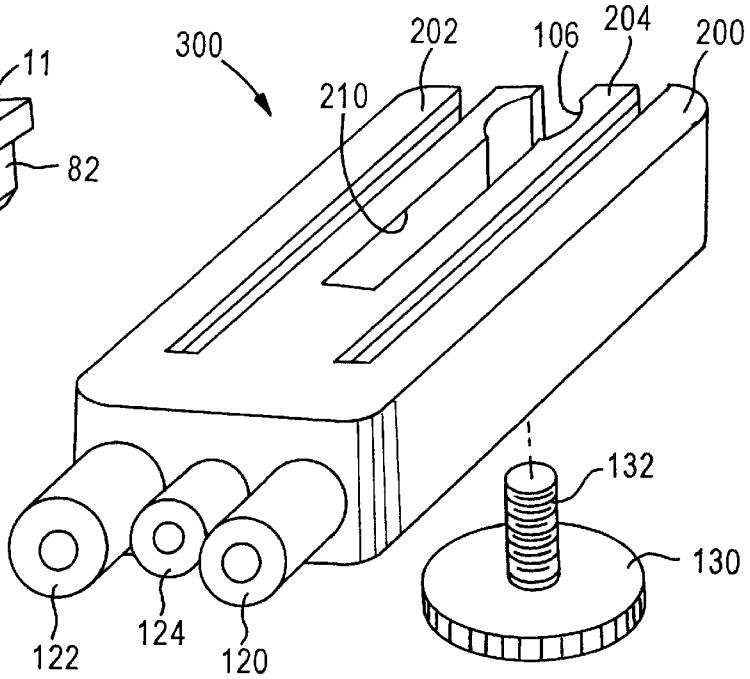
FIG. 6 is a perspective view of a housing for the tuning fork contacts of FIG. 5.

As depicted in FIGS. 3 and 4, a plurality of blades 11 are mounted within a non-metallic shroud 140. The blades 11 are secured in the shroud 140 in any known manner using the shoulders 80. The non-metallic shroud 140 has a flat platform 141 which includes a threaded hole 142 for receiving the threaded portion 132 of the thumb wheel 130. Exterior walls 146, 148, 150, 152 extend downwardly from the platform 141. As depicted in FIG. 3, the exterior walls 146, 148, 150, 152 are all deeper than the blades 11 so that the blades are not exposed. The tab slot 144 for receiving tab 126 on the housing 100 is formed in the wall 152. A longitudinal spacer 156 extends downwardly from the platform 141 and is located between blades 11. The longitudinal spacer 156 is the same height as walls 146, 148, 150, 152 and reduces the likelihood that an energized blade 11 is inadvertently brought into contact with another object. The longitudinal spacer 156 is received by the longitudinal slot 110 and mates therewith. The blades 11 are spaced apart the same distance as apertures 102, 104, respectively, in housing 100. A plurality of signal contacts 160 are located adjacent the blades 11. Advantageously, the signal contacts 160 permit the connector to transfer electrical power and electrical signals without requiring two different connectors.

In operation, the shroud 140 is brought into mating contact with the housing 100 at which time the blades 11 extend through apertures 102, 104 and into contacts 10. In this embodiment, the blades 11 are moved vertically to be brought into engagement with the contacts 10. The longitudinal spacer 156 mates with the longitudinal slot 110. The edge 88 facilitates the blades 11 engaging with the contacts 10. Once engaged, the thumbscrew 130 can be tightened into threaded hole 142 to prevent the housing 100 separating from the shroud 140.

Advantageously, the contact assembly 10 can be adjusted if the frictional resistance is either too high or too low. By adjusting the set screw 60, the second of the tines 16 is biased in a direction towards the first of the tines 18 and the spacing between the first 18 and second tines 16 is reduced. In this manner, the contact pressure and spacing can be adjusted so that when the blade 11 is inserted into the slot 20 formed by the tines16, 18, the frictional resistance can be adjusted by turning the set screw 60 in either a clockwise or counter-clockwise direction.

A second embodiment of the invention is depicted in FIGS. 5–8. The second embodiment differs primarily from the first embodiment in that the blades 11 are longitudinally inserted into the contacts 10 whereas in the first embodiment the blades 11 are inserted vertically.

Only differences between the first embodiment and the second embodiment will be discussed herein for brevity. The contacts 200 are modified to have the adjustable tensioner located below the slot 20 so that the set screw 60 does not interfere with the blade 11 when the blade 11 is inserted longitudinally. The adjustable tensioner in the second embodiment includes two elastic members 260 each positioned at a lower portion of tine 216. Corresponding threaded holes 224 (not shown) are located in tine 218 and are aligned with through bores 222 (not shown) in the tine 216. Set screws 260 extend through the through bores 222 and holes 248 (not shown) in the elastic members to adjust the spacing and contact pressure exerted by tines 216, 218 on the blade 11.

Figure 7:
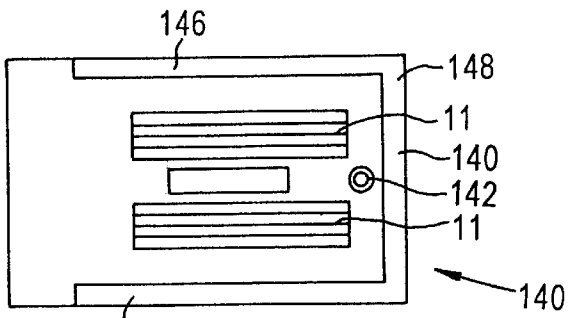
FIG. 7 is a bottom plan view of the shroud for the blade connectors of FIG. 5.
Figure 5:
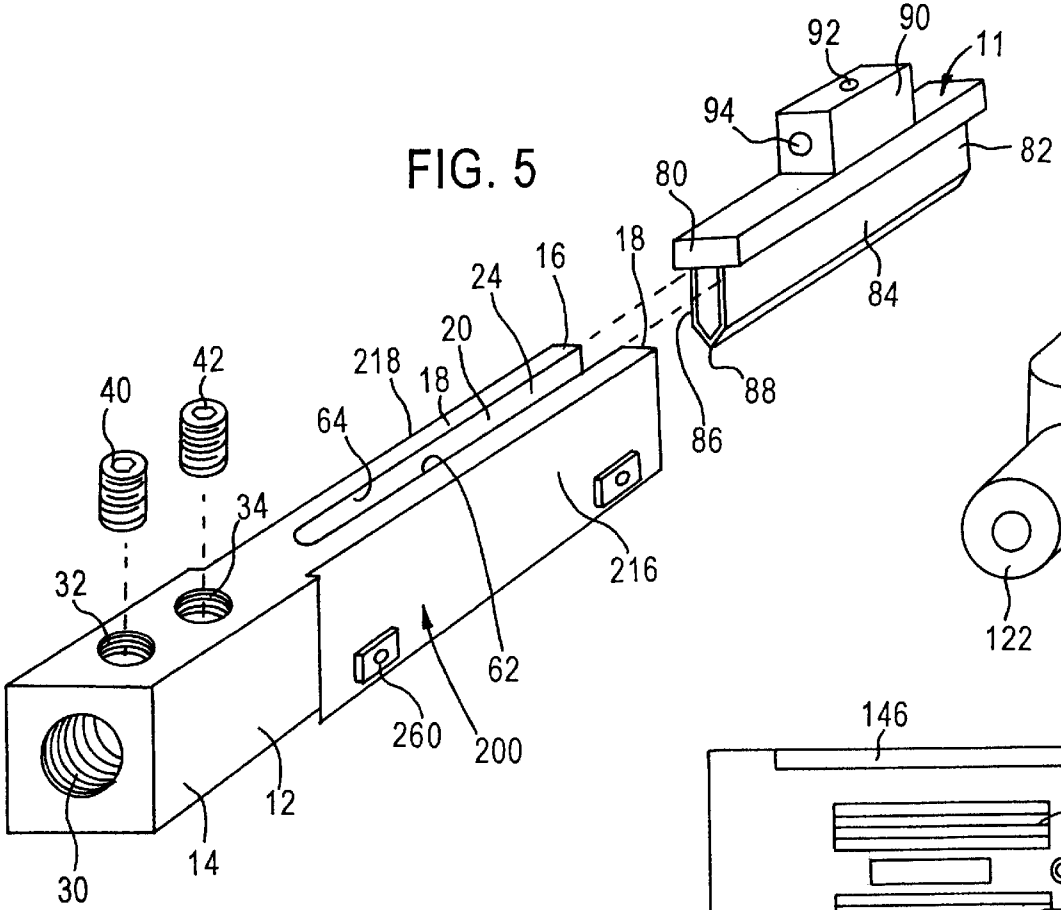
FIG. 5 is an exploded perspective view of the blade and contact connector according to a second embodiment of the present invention.

As depicted in FIG. 7, to permit the blades 11 to be inserted longitudinally, the elongated slots 202, 204 extend through a vertical outer wall of the housing 300. Similarly, slot 210 extends through the same outer vertical wall. The hole 106 has a larger diameter than the slot 210 so that the thumbscrew 130 is retained when the shroud and the housing. As compared to the first embodiment wall 152 is omitted to permit longitudinal engagement.

It will be readily seen by one of ordinary skill in the art that the present invention fulfills all of the objects set forth above. After reading the foregoing specification, one of ordinary skill will be able to affect various changes, substitutions of equivalents and various other aspects of the invention as broadly disclosed herein. It is therefore intended that the protection granted hereon be limited only by the definition contained in the appended claims and equivalents thereof.

What is claimed is:

1. An electrical connector, comprising:

at least two parallel blades mounted in a shroud;

at least two contacts mounted in a body, each contact having two parallel tines defining a slot; and an adjustable tensioner mounted to each of said contacts and having an adjustment member and an elastic member;

each of said blades receivable in a corresponding slot, each said adjustable tensioner for adjusting contact pressure with the respective blades and spacing between the respective tines.

2. The electrical connector of claim 1, wherein said body is non-metallic.

3. The electrical connector of claim 1, wherein each of said contacts includes a contact body from which each of said contacts extends and each of said contact body includes a portion for receiving an electrical wire.

4. The electrical connector of claim 1, wherein each of said contacts has a separate adjustable member, said elastic member is located at a distal end of one of said tines and said adjustment member is mounted at said distal end of said tine and said adjustment member extends through said elastic member.

5. The electrical connector of claim 4, wherein the adjustment member is a set screw and said elastic member is located on the exterior of said tine.

6. The electrical connector of claim 5, wherein the elastic member is rubber.

7. The electrical connector of claim 1, wherein each of said blades includes a rounded section for guiding said blades into respective slots.

8. The electrical connector of claim 1, wherein spacing between said slots and spacing between said blades are equal.

9. The electrical connector of claim 1, further comprising at least one strain relief for electrical wires connectable to said contacts.

10. The electrical connector of claim 1, wherein said shroud has an exterior portion and a longitudinal portion extending between each of said blades, distal ends of said blades being mounted within said exterior portion and said longitudinal portion.

11. The electrical connector of claim 1, wherein said housing includes at least two elongated apertures positioned exteriorly of said slots, said blades extending through said elongated apertures and receivable in corresponding slot.

12. The electrical connector of claim 1, wherein distal ends of said blades are mounted within said shroud.

13. The electrical connector of claim 1, further comprising a tab on said housing and a slot in said body, said tab receivable in said slot when said housing and body are mated together.

14. The electrical connector of claim 1, further comprising fastening means for holding said housing and said body together.

15. The electrical connector of claim 1, wherein said housing includes apertures for receiving signal pins in said body.

16. The electrical connector of claim 1, wherein said blades and contacts are mated vertically.

17. The electrical connector of claim 1, wherein said blades and contacts are mated longitudinally.

18. The electrical connector of claim 1, wherein said adjustable tensioner extends through said slot.

19. The electrical connector of claim 1, wherein said elastic member is vertically spaced from said slot and said adjustment member is aligned with said elastic member, said elastic member and said adjustment member positioned to allow said blade to mate with said contact in a longitudinal direction.

20. An electrical connector comprising:

at least two blades mounted in a shroud;

at least two contacts mounted in a body, each contact having two tines defining a slot;

adjustable tensioners for adjusting contact pressure with said blades and spacing between said tines, each said adjustable tensioner mounted to a respective one of said contacts and having an adjustment member and an elastic member;

each said elastic member being located at a distal end of a respective on of said tines and each said adjustment member being mounted at said distal end of said respective tine and said adjustment member extends through said elastic member.

* * * * *